US006379178B1

(12) United States Patent
Jones, III et al.

(10) Patent No.: US 6,379,178 B1
(45) Date of Patent: Apr. 30, 2002

(54) ADJUSTABLE VEHICLE POWER POINT

(75) Inventors: James L. Jones, III, White Lake; Chidambarakrishnan L. Rajesh, Canton; Michael M. Jordan, Dearborn, all of MI (US)

(73) Assignee: EWD, L.L.C.

( * ) Notice: Subject to any disclaimer, the term of this patent is extended or adjusted under 35 U.S.C. 154(b) by 56 days.

(21) Appl. No.: 09/634,558

(22) Filed: Aug. 9, 2000

(51) Int. Cl.[7] ..... H01R 13/72
(52) U.S. Cl. ..... 439/501; 439/110; 224/483
(58) Field of Search ..... 439/501, 532, 439/34, 110, 4; 224/483, 554; 320/105

(56) References Cited

U.S. PATENT DOCUMENTS 5,180,089 A * 1/1993 Suman et al. ..... 224/554
5,367,243 A * 11/1994 Wells et al. ..... 320/105
5,971,242 A * 10/1999 Schuerman ..... 224/554

FOREIGN PATENT DOCUMENTS

DE 3546221 A1 * 7/1987

* cited by examiner

*Primary Examiner*—Paula Bradley
*Assistant Examiner*—Felix O. Figueroa
(74) *Attorney, Agent, or Firm*—Young & Basile

(57) ABSTRACT

An adjustable power point for use in a vehicle, movable from at least one home position to other locations in the vehicle that are suited for connecting various electrical devices. In one form, the power point is connected to a retractable power cord, and is normally retained in a home socket, for example in the dashboard near the driver console. In another form, the power point is slide-mounted in a track structure formed in a portion of the vehicle, for example the instrument panel, capable of being longitudinally adjusted between various home positions along the length of the track.

4 Claims, 5 Drawing Sheets

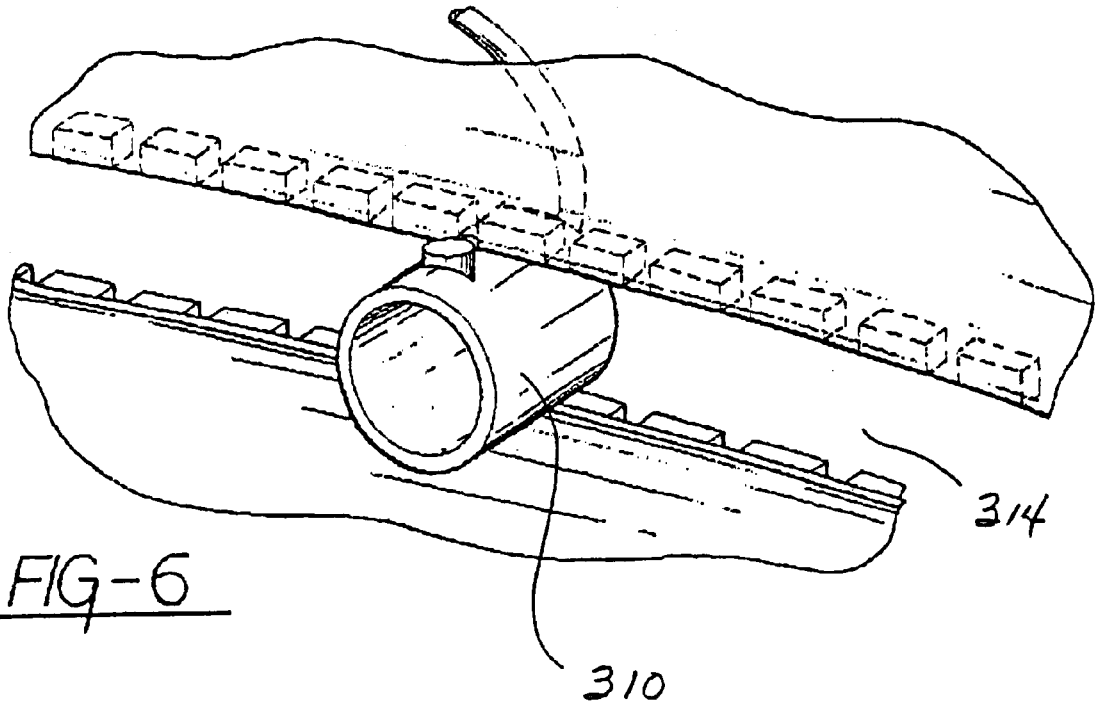
FIG-6
FIG-7
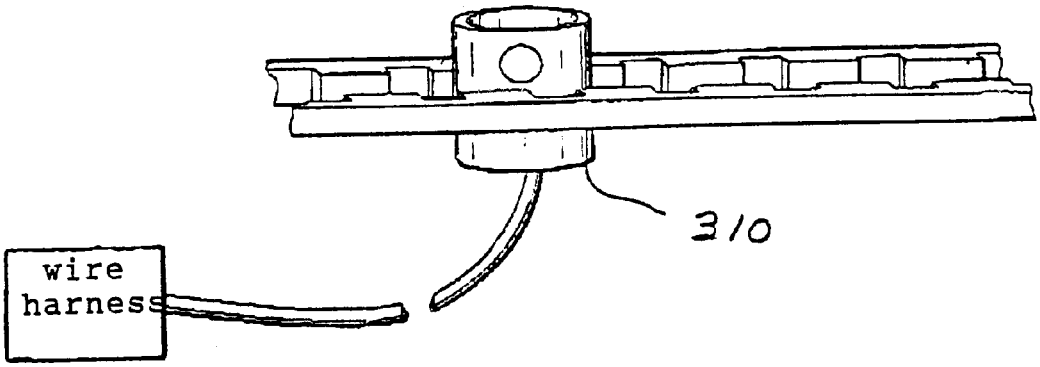

ADJUSTABLE VEHICLE POWER POINT

FIELD OF THE INVENTION

The present invention is in the field of vehicle power points, devices which have largely replaced cigarette lighters in order to supply direct current (usually 12 volts) to various appliances in the vehicle.

BACKGROUND OF THE INVENTION

Vehicle cigarette lighters have long provided a source of direct current (usually 12 volt) for powering cell phones, lights, tire re-inflating air compressors, CB radios, and other DC-using electrical appliances used by the occupants of a vehicle (even cigarette lighters). The old style cigarette lighters are largely being replaced by dedicated "power points" which are similar but have no cigarette-lighting function. Instead of a lighter coil plug, power points have an elastomeric plug to seal them when not in use.

The location of power points has largely been dictated by the traditional placement of old cigarette lighters, namely at locations convenient to the driver, and possibly to the users of ashtrays in rear portions of the vehicle. In recognition of the increasing use of DC electrical devices by vehicle occupants, power points are now starting to be placed in non-traditional locations, for example near the rear hatch of minivans to accommodate electric coolers, DC television sets, and the like. These non-traditional power point locations, however, are typically not geared toward the convenience of the passengers in the vehicle, being better suited for use when the vehicle is stopped and the rear door or hatch is opened.

SUMMARY OF THE INVENTION

The present invention is an adjustable power point movable between a normal rest position, for example convenient to the driver of the vehicle, to one or more different locations more convenient to the passengers of a vehicle.

In a first form, the adjustable power point can be extended from its home position, for example in a socket on, an instrument panel near the driver, to other locations in the vehicle, limited only by the length of a retractable power cord to which the power point is attached.

In a second form, the adjustable power point is slide-adjustable in a track on a vehicle panel.

These and other features and advantages of the invention will become apparent upon further reading of the specification in light of the accompanying drawings.

BRIEF DESCRIPTION OF THE DRAWINGS

FIG. 6 is a detailed view of the adjustable sliding mechanism and track of the power point in FIG. 5, including a schematic power supply illustration.

FIG. 7 illustrates one possible power supply arrangement for the power point of FIG. 5.

DETAILED DESCRIPTION OF THE ILLUSTRATED EMBODIMENTS

Figure 1:
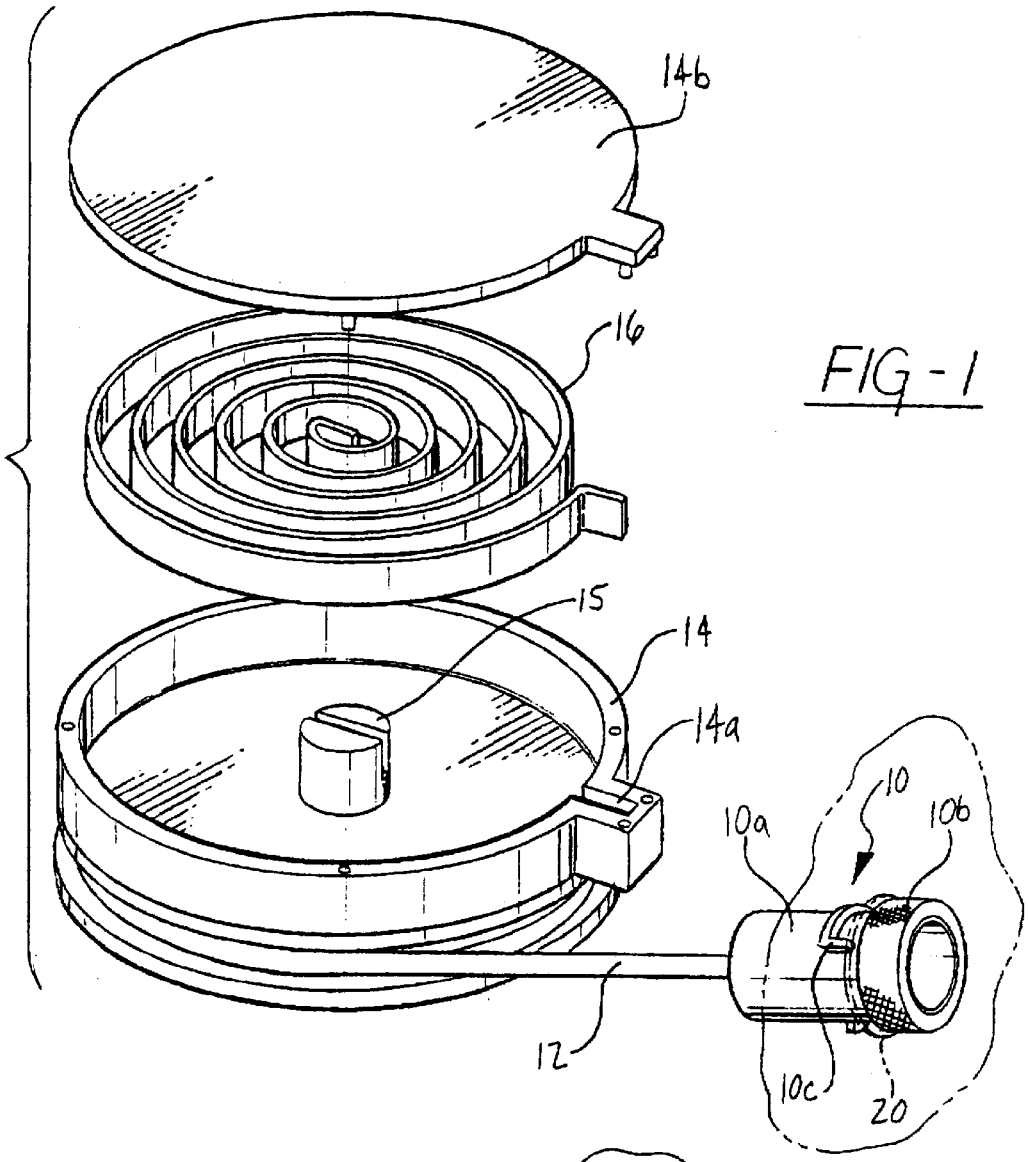
FIG. 1 is a perspective view of a retractable power point according to the present invention, including a retracting mechanism which is in exploded view.

Referring to FIG. 1, a first embodiment of an adjustable power point according to the invention is illustrated as a retractable power point 10 operating on a principle similar to that of a tape measure, seat belt, or other known retractable cord, strap, or tape type device. Power point 10 has a generally conventional body 10*a* including internal contacts of a type well-known to those skilled in the art for suppling DC current to the contacts of a mating cigarette lighter-type plug, also well-known and commercially available on many different devices intended for use in a vehicle. Power point 10, however, is designed to be removable from a "home" or rest position such as a socket in an instrument panel, and for that purpose power point 10 is illustrated with an enlarged collar or grip portion 10*b* having a diameter sized to be larger than a receiving socket 20, and a locking mechanism 10*c* molded or otherwise formed in body 10*a* (which normally will be of an insulated plastic material) for a bayonet-type lock with internal mating structure in the socket.

Retractable power point 10 is connected to a power cord 12 of up to several feet in length. Power cord 12 is electrically connected at one end to a wire harness in known fashion, for example using standard male/female wire harness connectors, with the bulk of its intermediate length being wound around a spring-loaded spool 14 mounted at a convenient location underneath the panel or other vehicle feature supporting the socket.

Spool 14 is supported on and rotates around a post 15 which extends into the interior of the spool to lockingly engage one end of a flat coil spring 16 contained by spool cover 14*b*, while the other end of flat coil spring 16 is secured in a recess or receptacle 14*a* in the spool. As power point 10 is pulled from its home socket to a location in the vehicle more convenient for the user, spool 14 rotates and progressively winds spring 16 under tension so that its tendency is to pull the power point back into the socket under a light to moderate spring force to (1) allow it to be returned easily without the user having to stuff slack cord into the socket and (2) maintain a light tension on the cord to eliminate slack while the power point is plugged into a device at a remote location in the vehicle.

It will be understood by those skilled in the art that spool 14 could be provided with a rack or ratchet mechanism of known type to lock it in place at a pulled position, somewhat in the manner of a tape measure or a window shade, which lock would be released upon a quick outward tug and sudden release of the power point in the direction of the socket in a manner well-known to those skilled in the art (and even to those not skilled in the art).

It will further be understood that while a particular example of a retracting mechanism is shown for purposes of illustration in FIG. 1, virtually any known retracting mechanism for cord-like objects could be used to retractably anchor power point 10 retractable according to the invention.

Figure 2:
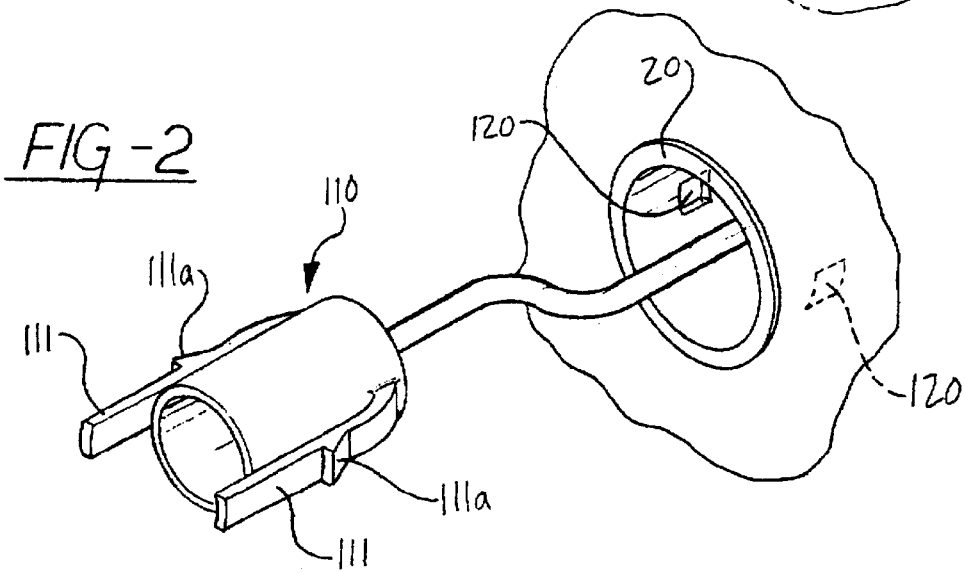
FIG. 2 is a perspective view of a retractable power point according to the present invention, in relation to a home socket, partially extended, and illustrating an alternate socket-retaining mechanism on the power point body.

FIG. 2 illustrates a slightly different retractable power point 110 mounted in home socket 20 and using the retracting mechanism of FIG. 1, but with a different locking structure on the power point body comprising two flexible lock arms 111 molded integrally with the power point body and having two beveled locking projections 111*a* adapted to releasably mate with two indentations or apertures 120 in socket 20. It will thus be understood that the manner of securing a retractable power point according to the present invention in a home position can be accomplished in many known ways and with many different types of locking structure, both on the power point and/or in the socket. It is even possible to have the power point simply remain in the socket under spring tension from the retraction mechanism, without any positive locking structure between the power point and socket.

Figure 3:
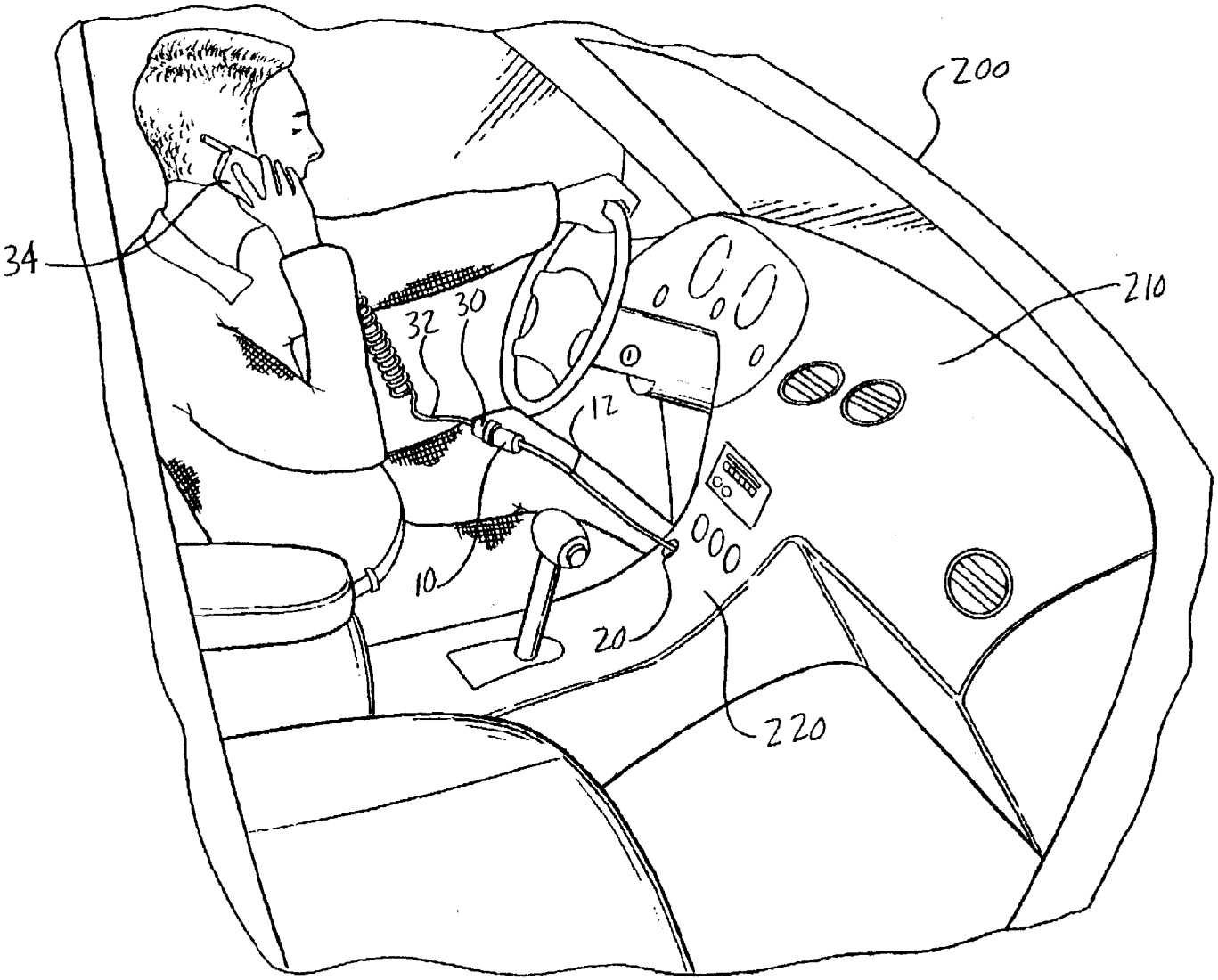
FIG. 3 is a perspective view of the interior of a vehicle, in which the instrument panel near the driver incorporates a retractable power point according to FIG. 1, illustrating the power point pulled out of its rest socket toward the driver to assist with the use of a cell phone.

Referring next to FIG. 3, the retractable power point 10 of FIG. 1 is illustrated at a typical location in a vehicle 200, namely socket 20 in the console portion 220 of an instrument panel 210. This is the traditional cigarette lighter location, where convenience for the driver of the vehicle is paramount, and it can be seen that the retractable nature of power point 10 can be useful even to the driver. For example, the driver may be using a device such as a portable phone 34 having a relatively short power supply cord 32. In that case, the driver can simply retract power point 10 from socket 20, insert plug 30 from phone cord 32, and have a very convenient and slack-free extension to eliminate annoying and potentially dangerously distracting short-cord attachment of the phone to the socket.

Figure 4:
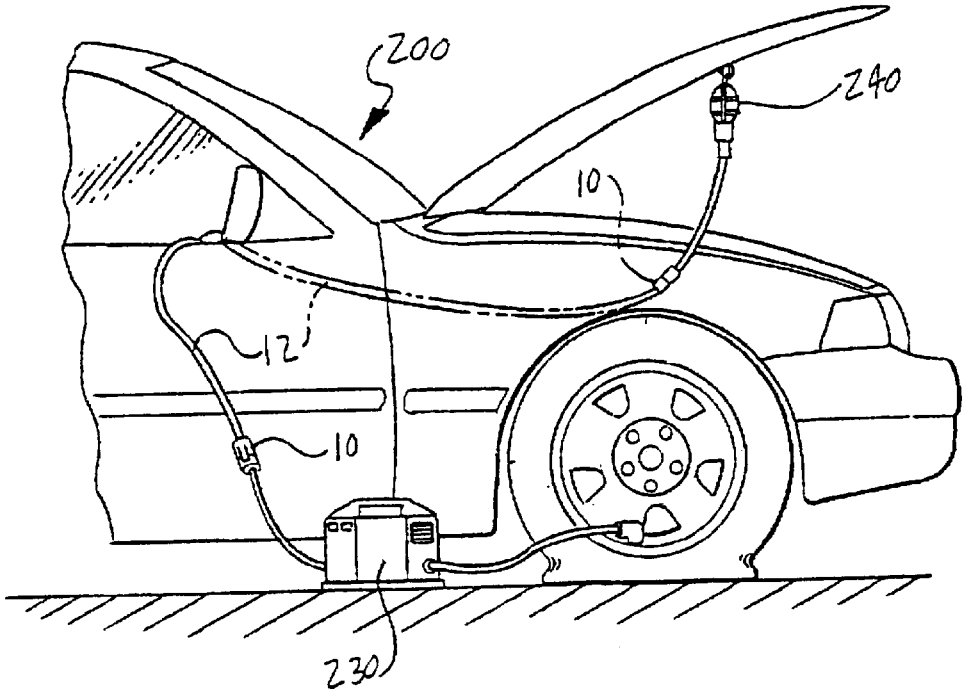
FIG. 4 is an elevational side view of a vehicle in distress, with retractable power point according to FIGS. 1–3 being extended outside the vehicle through an open window to power various emergency appliances.

Referring next to FIG. 4, the length of cord 12 on retractable power point 10 is preferably long enough to service all passenger locations in the vehicle, and optionally can be long enough to service locations outside the vehicle, for example where it is desirable to power an external appliance when the vehicle is stopped. In FIG. 4 power point 10 is shown extended out through an open car window to power devices such as a DC-powered air compressor 230 and an emergency light 240.

Figure 5:
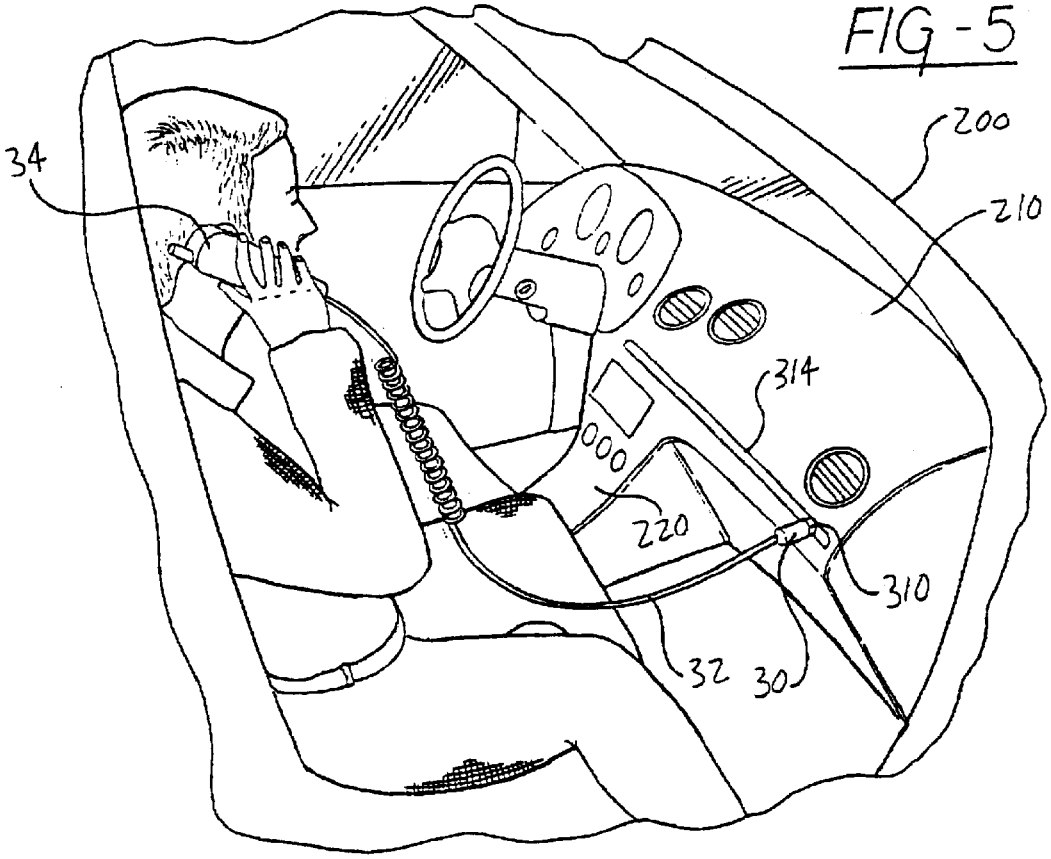
FIG. 5 is a perspective view of the interior of a vehicle, illustrating an alternate version of the adjustable power point according to the invention, in which a passenger is utilizing the adjustment feature to accommodate a short cell phone cord.
Figure 8:
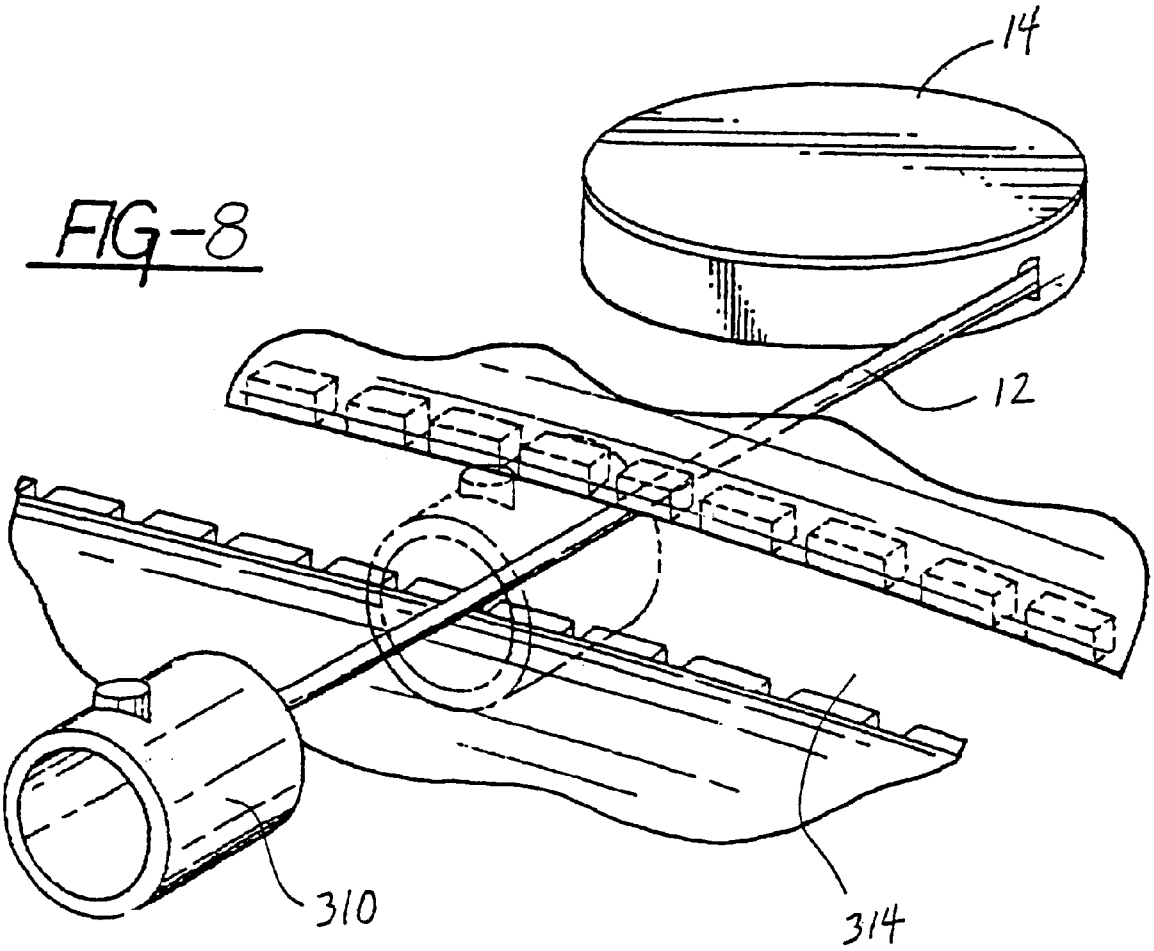
FIG. 8 illustrates the adjustable sliding mechanism and track of FIG. 6 supplemented with the retracting mechanism of FIG. 1.

Referring next to FIG. 5, an alternate adjustable power point 310 is illustrated as a slide-adjustable power point in a track or slot 314 built into instrument panel 210 in the vehicle. This allows power point 310 to slide back and forth from a "traditional" position at or near driver console 220 across the width of the vehicle to the passenger side near the door and window, thereby accommodating the passenger hampered with a short-corded device and/or a passenger-side device outside a vehicle.

Sliding power point 310 can be infinitely adjustable within track 314, or can be adjustable through a finite series of "home" positions where it is releasably locked in place with simple detent or push button structure engaging various locking recesses spaced along the length of the slot. An example of such adjustable slide-track locking structures illustrated in FIG. 6 is one possible structure among many which will be apparent to those skilled in the art.

The slide-adjustable power point 310 of FIGS. 5 and 6 is useful in that it allows a plurality of home positions, rather than a single retractable home position. This is primarily useful where it may be desired to leave the power point in a particular adjusted position, or to avoid having a length of retractable cord 12 extending across the interior of the vehicle. The adjustable home position of the embodiment in FIG. 5 also allows fine tuning of a preferred home position for a frequent user of devices receiving power from power point 310.

It will be apparent to those skilled in the art that the retractable feature of the embodiment of FIG. 1 can be combined with the slide-track adjustment of FIG. 5, to produce an adjustable power point which can be adjusted between various home positions on a semipermanent basis, and which further can be extended from and retracted to any of the various home positions on a retractable cord 12 such as that shown in FIGS. 1–4.

Now that we have disclosed the preferred embodiments of our invention, many other modifications and variations of the invention will be apparent to those skilled in the art without departing from the scope of the invention. While front seat, instrument-panel home positions are illustrated, it will be apparent to those skilled in the art that the principles and structures of the invention can be applied to virtually any home position in the vehicle, including rear cargo areas, rear seats, and even trunks and engine compartments. While a socket-type home position is preferred, other power point securing structures can be used to define a home position, for example resilient clips or brackets molded into the vehicle panel. These and others are included within the scope of the following claims.

Accordingly, we claim:

1. In a vehicle, a power point movable from a home position on the vehicle to a use position remote from the home position wherein the home position is located on a track structure on a portion of the vehicle and the power point is mounted to slide on the track structure, wherein the power point further includes a retractable cord to which it is connected and which permits the power point to be removed from the track structure and extended to a remote use location in the vehicle.

2. In a vehicle, a power point for providing operating current to a DC-using appliance of a type used in a vehicle, the power point being adapted to receive a power plug from such an appliance, the power point being movable from a home position on or in a securing structure on the vehicle to a use position remote from the home position, wherein the securing structure comprises a track structure on a portion of the vehicle and the power point is mounted to slide on or in the track structure.

3. The power point of claim 2, wherein the power point and the track structure include mating features for releasably locking the power point in a plurality of home positions on the track structure.

4. The power point of claim 3, wherein the track structure is in a vehicle instrument panel.

* * * * *